US009105228B2

(12) United States Patent
Lee et al.

(10) Patent No.: US 9,105,228 B2
(45) Date of Patent: Aug. 11, 2015

(54) ORGANIC LIGHT EMITTING DIODE DISPLAY DEVICE FOR IMPROVING DISPLAY QUALITY AND METHOD FOR DRIVING ORGANIC LIGHT EMITTING DIODE DISPLAY PANEL

(75) Inventors: Chien-Ya Lee, Taipei (TW); Tsung-Ting Tsai, Tainan (TW)

(73) Assignee: Au Optronics Corporation, Hsinchu (TW)

( * ) Notice: Subject to any disclaimer, the term of this patent is extended or adjusted under 35 U.S.C. 154(b) by 199 days.

(21) Appl. No.: 13/602,203

(22) Filed: Sep. 3, 2012

(65) Prior Publication Data

US 2013/0293525 A1 Nov. 7, 2013

(30) Foreign Application Priority Data

May 2, 2012 (TW) ..... 101115570 A

(51) Int. Cl.

*G09G 3/30* (2006.01)
*G09G 3/32* (2006.01)
*G09G 3/20* (2006.01)

(52) U.S. Cl.

CPC ..... *G09G 3/32* (2013.01); *G09G 3/2025* (2013.01); *G09G 3/3233* (2013.01); *G09G 2300/0842* (2013.01); *G09G 2310/0245* (2013.01); *G09G 2320/043* (2013.01)

(58) Field of Classification Search

CPC ..... H04N 13/00
USPC ..... 345/76
See application file for complete search history.

(56) References Cited

U.S. PATENT DOCUMENTS

| | | | | |
|---|---|---|---|---|
| 7,557,791 | B2 | 7/2009 | Tokumura | |
| 2006/0072047 | A1 * | 4/2006 | Sekiguchi | 349/25 |
| 2007/0035484 | A1 * | 2/2007 | Chang | 345/76 |
| 2007/0152923 | A1 * | 7/2007 | Baik et al. | 345/76 |
| 2011/0157143 | A1 | 6/2011 | Choi et al. | |
| 2012/0019569 | A1 * | 1/2012 | Byun | 345/690 |
| 2012/0105421 | A1 * | 5/2012 | Tsai et al. | 345/212 |

FOREIGN PATENT DOCUMENTS

| | | |
|---|---|---|
| CN | 1873753 | 12/2006 |
| TW | I312639 | 7/2009 |

* cited by examiner

*Primary Examiner* — Roy Rabindranath
(74) *Attorney, Agent, or Firm* — Jianq Chyun IP Office

(57) ABSTRACT

An organic light emitting diode (OLED) display device and a method for driving an OLED display panel are provided. The method includes the following steps. In a reset period, a plurality of scanning signals received by a plurality of pixels of the OLED display panel is simultaneously enabled, and a plurality of data-voltages received by the pixels are set to a reference-voltage. In a threshold voltage cancelling period, a system-high-voltage received by the pixels and the scanning signals are simultaneously enabled, and the data-voltages are set to the reference-voltage. In a scanning period, the scanning signals are sequentially enabled, and the data-voltages are set according to the corresponded displaying data within a plurality of displaying data.

20 Claims, 5 Drawing Sheets

ORGANIC LIGHT EMITTING DIODE DISPLAY DEVICE FOR IMPROVING DISPLAY QUALITY AND METHOD FOR DRIVING ORGANIC LIGHT EMITTING DIODE DISPLAY PANEL

CROSS-REFERENCE TO RELATED APPLICATION

This application claims the priority benefit of Taiwan application serial no. 101115570, filed on May 2, 2012. The entirety of the above-mentioned patent application is hereby incorporated by reference herein and made a part of this specification.

BACKGROUND

1. Technical Field

The disclosure relates to a display device and a method for driving a display panel, in particularly, to an organic light emitting diode display device and a method for driving an organic light emitting diode display panel.

2. Description of Related Art

Information and communication industry has become the current mainstream industry, and especially the various types of portable communication products are the focus of development. Because the flat panel display is a communication interface between people and information, the development of the flat panel display seems to be very important. Since an organic light emitting display has the advantages of self-luminous, wide viewing angle, low power consumption, program simplicity, low cost, wide rage of operating temperature, high response speed, full color, and so forth, providing it with a great potential, and thus is expected to become the mainstream of the next-generation flat panel display. Because the organic light emitting display uses an organic light emitting diode (OLED) as a display element, the driving method is different from a liquid crystal display.

In general, current flowing through the organic light emitting diode is to be controlled by a switch element (e.g., transistor); therefore, the electrical characteristics of the switch element must be considered when designing the light emitting brightness of the organic light emitting diode (corresponding to the displayed greyscale), but the impact from the process is to differ the electrical characteristics of the switch element, so that the light emitting brightness of the organic light emitting diode is unable to be properly controlled. Moreover, the scanning method of the organic light emitting display generally is row-by-row scanning; taking for example the top to bottom row-by-row scanning, the brightness of the entire screen may appear to be lighter at the top and darker at the bottom.

SUMMARY

The disclosure is directed to an organic light emitting diode display device and a method for driving an organic light emitting diode (OLED) display panel, capable of compensating the electrical characteristics of a switch element that coupled to an organic light emitting diode, so as to improve the display quality of the organic light emitting diode display panel.

The disclosure provides a method for driving an organic light emitting diode display panel, comprising: in a reset period, a plurality of scanning signals received by a plurality of pixels of the organic light emitting diode display panel is simultaneously enabled, and a plurality of data-voltages received by the pixels is set to a reference-voltage; in a threshold voltage cancelling period, a system-high-voltage received by the pixels and the scanning signals are simultaneously enabled, and the data-voltages are set to the reference-voltage; in a scanning period, the scanning signals are enabled sequentially, and the data-voltages are set according to a corresponded displaying data within a plurality of displaying data, wherein the enabling periods of the scanning signals do not overlap with each other.

The disclosure also provides an organic light emitting diode display device, comprising an organic light emitting diode display panel, a power supply unit, a data driver, a scan driver, and a timing controller. The organic light emitting diode display panel has a plurality of pixels. The power supply unit couples the organic light emitting diode display panel to provide a system-high-voltage and a system-low-voltage to the pixels. The data driver couples the organic light emitting diode display panel to provide a plurality of data-voltages to the pixels. The scan driver couples the organic light emitting diode display panel to provide a plurality of scanning signals to the pixels. The timing controller couples the data driver and the scan driver. In a reset period, the timing controller controls the scan driver to simultaneously enable the scanning signals, and controls the data driver to set the data-voltages to a reference-voltage. In a threshold voltage cancelling period, the timing controller controls the scan driver to simultaneously enable the scanning signals, controls the power supply unit to enable the system-high-voltage, and controls the data driver to set the data-voltages to the reference-voltage. In a scanning period, the timing controller controls the scan driver to sequentially enable the scanning signals, and controls the data driver to set the data-voltages according to a plurality of displaying data, wherein the enabling periods of the scanning signals do not overlap with each other.

In an embodiment, the organic light emitting diode display device further comprises a look-up table, and the displaying data respectively transmits a plurality of gray scale values, wherein the timing controller adjusts a plurality of voltage values corresponding to the gray scale values in accordance with the look-up table and the enabled timings of the scanning signals.

In an embodiment, the timing controller gradually raises the voltage values corresponding to the gray scale values in accordance with the look-up table and the enabled timings of the scanning signals.

In an embodiment, in the reset period, the timing controller controls the power supply unit to disable the system-high-voltage.

In an embodiment, the organic light emitting diode display panel displays a three-dimensional screen constituted by a first eye image and a second eye image, the enabling sequence of the scanning signals in the scanning period of a first sub-frame period of a first frame period is opposite to the enabling sequence of the scanning signals in the scanning period of a second sub-frame period of a second frame period, the enabling sequence of the scanning signals in the scanning period of a third sub-frame period of the first frame period is opposite to the enabling sequence of the scanning signals in the scanning period of a fourth sub-frame period of the second frame period, the first sub-frame period and the second sub-frame period are corresponded to the first eye image, and the third sub-frame period and the fourth sub-frame period are corresponded to the second eye image.

In an embodiment, the enabling sequence of the scanning signals in the scanning period of the first sub-frame period is the same as the enabling sequence of the scanning signals in the scanning period of the third sub-frame period.

In an embodiment, the enabling sequence of the scanning signals in the scanning period of the first sub-frame period is opposite to the enabling sequence of the scanning signals in the scanning period of the third sub-frame period.

In an embodiment, the first frame period is adjacent to the second frame period.

In an embodiment, the displaying data respectively transmits a plurality of gray scale values, and a plurality of voltage values corresponding to the gray scale values are adjusted in accordance with the enabled timings of the scanning signals.

In an embodiment, the steps for adjusting the voltage values corresponding to the gray scale values in accordance with the enabled timings of the scanning signals comprise: gradually raises the voltage values corresponding to the gray scale values in accordance with the enabled timings of the scanning signals.

In an embodiment, the time lengths of the enabling periods of the scanning signals are between 0.5~2 μs in the scanning period. Furthermore, the time lengths of the enabling periods of the scanning signals can be between 0.6~0.8 μs.

In an embodiment, the system-high-voltage is disabled in the reset period.

According to the forgoing, the embodiments of the organic light emitting diode display device and the method for driving an organic light emitting diode display panel, in the threshold voltage cancelling period, the scanning signals and the system-high-voltage received by the pixels are simultaneously enable, and set the data-voltages to the reference-voltage, so as to compensate a threshold voltage of a transistor that coupled to an organic light emitting diode. As a result, the display quality of the organic light emitting diode display panel can thus be improved.

In order to make the aforementioned and other features and advantages of the disclosure comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a portion of this specification. The drawings illustrate embodiments of the disclosure and, together with the description, serve to explain the principles of the disclosure.

DETAILED DESCRIPTION OF DISCLOSED EMBODIMENTS

Figure 1:
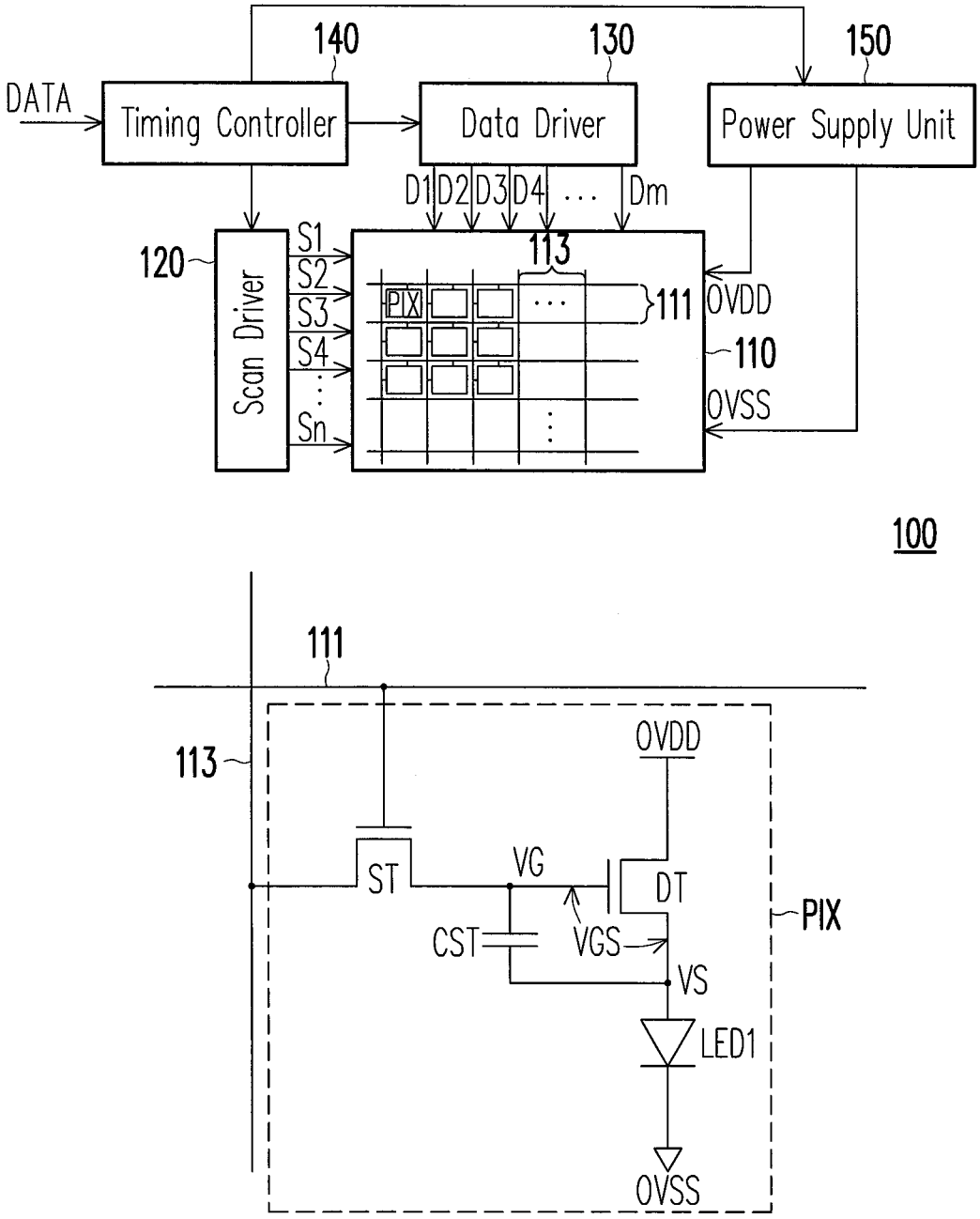
FIG. 1 is a schematic diagram illustrating an organic light emitting diode display device in accordance with an embodiment.

FIG. 1 is a schematic diagram illustrating an organic light emitting diode display device in accordance with an embodiment. Referring to FIG. 1, in the embodiment, the organic light emitting diode display device 100 at least comprises an organic light emitting diode display panel 110, a scan driver 120, a data driver 130, a timing controller 140, and a power supply unit 150. Wherein, the organic light emitting diode display panel 110 has a plurality of scan lines 111, a plurality of data lines 113 and a plurality of pixels PIX, and each of the pixels PIX couples to the corresponded scan line 111 and the corresponded data line 113. The scan driver 120 couples to the organic light emitting diode display panel 110 so as to provide a plurality of scanning signals S1~Sn to the pixels PIX through the scan lines 111, wherein n is a positive integer. The data driver 130 couples to the organic light emitting diode display panel 110 so as to provide a plurality of data-voltages D1~Dm to the pixels PIX through the data lines 113, wherein m is a positive integer.

The power supply unit 150 couples to the organic light emitting diode display panel 110 to provide a system-high-voltage OVDD and a system-low-voltage OVSS to the pixels PIX. The timing controller 140 couples to the data driver 130, the scan driver 120 and a power supply unit 150, and receives a plurality of displaying data DATA, for controlling the scan driver 120 to provide the scanning signals S1~Sn, for controlling the data driver 130 to provide the data-voltages D1~Dm, and for controlling the power supply unit 150 to provide the system-high-voltage OVDD and the system-low-voltage OVSS.

In the embodiment, each of the pixels PIX comprises a switch transistor ST, a driver transistor DT, a storage capacitor CST, and an organic light emitting diode LED1. Wherein, the transistors ST and DT are, for example, Metal-Oxide-Semiconductor Field Effect Transistor (MOSFET), and the organic light emitting diode LED1 is, for example, Polymer Light-Emitting Diode (PLED), but the disclosure is not limited thereto.

A gate electrode of the switch transistor ST couples to the corresponded scan line 113 to receive the corresponded scanning signals (e.g., S1~Sn), a drain electrode of the switch transistor ST couples to the corresponded data line 113 to receive the corresponded data-voltage (e.g., D1~Dm). A gate electrode of the driver transistor DT couples to a source electrode of the switch transistor ST, and a drain electrode of the driver transistor DT receives the system-high-voltage OVDD. The storage capacitor CST couples between the gate electrode and a source electrode of the driver transistor DT. An anode of the organic light emitting diode LED1 couples to the source electrode of the driver transistor DT, and a cathode of the organic light emitting diode LED1 receives the system-low-voltage OVSS.

Figure 2:
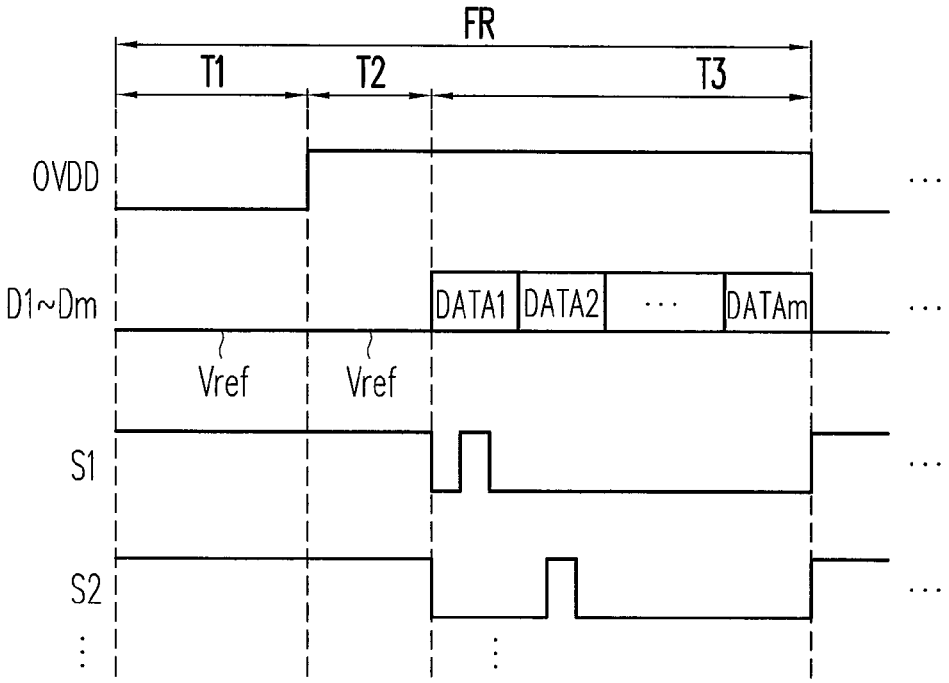
FIG. 2 is a timing diagram of a driving waveform in accordance with an embodiment.

FIG. 2 is a timing diagram of a driving waveform in accordance with an embodiment. Referring to FIG. 1 and FIG. 2, in the embodiment, a frame period FR is assumed to comprise a reset period T1, a threshold voltage cancelling period T2 and a scanning period T3, wherein the reset period T1, the threshold voltage cancelling period T2 and the scanning period T3 are assumed to be adjacent. However, in other embodiments, according to the method for driving the organic light emitting diode display panel 110, the reset period T1, the threshold voltage cancelling period T2 and the scanning period T3 may be adjacent or non-adjacent, and the change thereof may be done in accordance to the design from one of ordinary skill in the art.

In the reset period T, the timing controller 140 controls the scan driver 120 simultaneously enable the scanning signals S1~Sn to simultaneously turn on all the pixels PIX of the organic light emitting diode display panel 110. Moreover, the timing controller 140 controls the data driver 130 to transmit the data-voltages D1~Dm that are set to a reference-voltage Vref (herein taking the system-low-voltage OVSS for instance) to the organic light emitting diode display panel 110, so as to write the system-low-voltage OVSS into all the pixels PIX of the organic light emitting diode display panel 110. In other embodiments, the reference-voltage Vref is set to a direct current (DC) voltage with any voltage level, and accordingly set by one of ordinary skill in the art.

Now, the switch transistor ST of each of the pixels PIX is turned on after received the scanning signal S1 with the enabling level (for instance, a high voltage level), so that the data-voltage (e.g., D1~Dm) set to the system-low-voltage OVSS is transmitted to the storage capacitor CST, and the data-voltages (e.g., D1~Dm) are exploited to control the gate electrode of the driver transistor DT. Wherein, the storage capacitor CST gradually turns off the driver transistor DT due to the discharging caused by the system-low-voltage OVSS transmitted by the data-voltages (e.g., D1~Dm). Moreover, the timing controller 140 may control the power supply unit 150 to disable the system-high-voltage OVDD, such that the voltage level of the system-high-voltage OVDD is close or identical to the system-low-voltage OVSS, so that the discharging rate of each of the pixels PIX is speed up, wherein the voltage level of the system-high-voltage OVDD may be lower than the system-low-voltage OVSS.

In the embodiment, the gate electrode of the driver transistor DT of each of the pixels PIX receives the data-voltage (e.g., D1~Dm) that are set to the system-low-voltage OVSS, and thus the driver transistor DT is turned off. Under the condition that the driver transistor DT is turned off and the system-high-voltage OVDD is disabled, no current flows through the organic light emitting diode LED1 of each of the pixels PIX. Therefore, the organic light emitting diode display panel 110 displays a black screen. By doing so, the problem of screen afterimage of the organic light emitting diode display device 100 is improved.

In the threshold voltage cancelling period T2, the timing controller 140 also controls the scan driver 120 to simultaneously enable the scanning signals S1~Sn, and controls the data driver 130 to also set the data-voltages D1~Dm to the reference-voltage Vref (also, herein taking the system-low-voltage OVSS for instance). In other embodiments, the reference-voltage Vref of the threshold voltage cancelling period T2 may be different from the reference-voltage of the reset period T1, and may be accordingly set by one of ordinary skill in the art. Moreover, the timing controller 140 enables the system-high-voltage OVDD received by the pixels PIX, namely, the system-high-voltage OVDD is returned to the original high voltage level.

Now, the switch transistors ST of all the pixels PIX are turned on, and the data-voltages (e.g., D1~Dm) that set to the system-low-voltage OVSS are transmitted to the storage capacitors CST through the turned on switch transistors ST. Since the switch transistors ST of all the pixels PIX are turned on, the driver transistors DT of all the pixels PIX are receives the system-low-voltage OVSS transmitted by the corresponded data lines 113, and thus the voltages VGS between the gate electrodes and the source electrodes of the driver transistors DT of all the pixels PIX are close or identical to a threshold voltage thereof. Since the storage capacitors CST are coupled between the gate electrodes and the source electrodes of the driver transistors DT, the storage capacitors CST are stored the threshold voltage of the driver transistors DT coupled thereof.

In the scanning period T3, the timing controller 140 controls the power supply unit 150 to maintain the system-high-voltage OVDD at the enabling level, and controls the scan driver 120 to sequentially enable the scanning signals S1~Sn, wherein the enabling periods of the scanning signals S1~Sn are not overlapping with each other. In addition, the timing controller 140 controls the data driver 130 to respectively set the data-voltages D1~Dm according to the displaying data (e.g., DATA1~DATAm), wherein each of the data-voltages D1~Dm is set according to the corresponded displaying data (DATA1~DATAm). Therefore, the switch transistor ST of each of the pixels PIX is turned on after received the scanning signals (e.g., S1~Sn) with the enabling level, so as to transmit the corresponded data-voltage (e.g., D1~Dm) to the storage capacitor CST. The storage capacitor CST is charged in accordance with the corresponded data-voltage (e.g., D1~Dm), and the conduction degree of the driver transistor DT is corresponded to the voltage across the storage capacitor CST, thus controlling the organic light emitting diode LED1 to emit light in accordance with the corresponded data-voltage (e.g., D1~Dm).

Since the voltage VGS between the gate electrode and the source electrode of the driver transistor DT is stored in the storage capacitor CST in the threshold voltage cancelling period T2, the voltage across the storage capacitor CST (equivalent to the voltage VGS between the gate electrode and the source electrode of the driver transistor DT) is raised from the threshold voltage of the driver transistor DT when the data-voltages (e.g., D1~Dm) of the corresponded displaying data (e.g., DATA1~DATAm) are transmitted to the storage capacitor CST through the turned on switch transistor ST, and thus the data-voltages (e.g., D1~Dm) is designed to target the displaying data (e.g., DATA1~DATAm) without considering the threshold voltage of the driver transistor DT.

Figure 3:
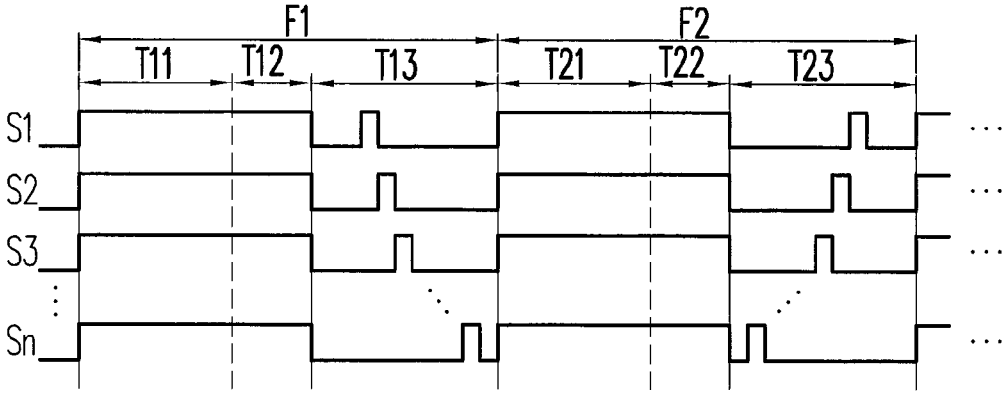
FIG. 3 is a waveform diagram of a plurality of scanning signals under a two-dimensional display mode in accordance with an embodiment.

FIG. 3 is a waveform diagram of a plurality of scanning signals under a two-dimensional display mode in accordance with an embodiment. Referring to FIG. 1 to FIG. 3, when the organic light emitting diode display panel 110 is in a two-dimensional display mode, namely, displaying a flat screen, the organic light emitting diode display panel 110 is generally scanned once in a single frame period. According to FIG. 2, the scanning signals S1~Sn are sequentially enabled in the scanning period T3, and are simultaneously enabled in reset period T1. Therefore, the firstly enabled pixels PIX (such as the pixels PIX receiving the scanning signal S1) have more display time, so that the brightness displayed by the firstly enabled pixels PIX is brighter (in terms of the data voltages in correspondence with a same gray scale value), namely, much more current is flowed through the organic light emitting diode LED1 of the firstly enabled pixels PIX. According to the above, in order to balance the brightness distribution of the screen, the enabling sequences of the scanning signals S1~Sn of the scanning periods (e.g., T13 and T23) of two adjacent frame periods (e.g., a first frame F1 and a second frame F2) are opposite.

Furthermore, assuming that the first frame period F1 has a reset period T11, a threshold voltage cancelling period T12 and a scanning period T13, and the second frame period F2 has a reset period T21, a threshold voltage cancelling period T22 and a scanning period T23, wherein the actions of the organic light emitting diode display device 100 in the reset period T11, T21 and in the threshold voltage cancelling period T12, T22 can be referred to the descriptions of the embodiment illustrated in FIG. 2, and thus are not repeated herein. Moreover, assuming that the scanning signals S1~Sn are respectively corresponded to the entire pixels PIX of the organic light emitting diode display panel 110 and the pixels PIX corresponded to the scanning signals S1~Sn are arranged row-by-row from the top to the bottom of the organic light emitting diode display panel 110 (in terms of the orientation shown in the figure, the disclosure is not limited thereto).

During the scanning period T13 of the first frame period F1, the timing controller 140 controls the scan driver 120 to sequentially enable from the scanning signals S1 to the scanning signals Sn (i.e. the enabling sequence of the scanning signals S1~Sn is S1~Sn), so that the upper region of the organic light emitting diode display panel 110 is appeared to be brighter, and the lower region of the organic light emitting diode display panel 100 is appeared to be darker. During the scanning period T23 in the second frame period F2, the timing controller 140 controls the scan driver 120 to sequentially enable from the scanning signals Sn to the scanning signals S1 (i.e., the enabling sequence of the scanning signals S1~Sn is Sn~S1), so that the upper region of the organic light emitting diode display panel 110 is appeared to be darker, and the lower region of the organic light emitting diode display panel 100 is appeared to be brighter. According to the above, using the driving enabling sequences of the scanning signals in the two adjacent frame periods are opposite to each other, the brightness distributions of the images in the two adjacent frame periods is balanced. By the visual persistence mechanism of naked eye, the entire organic light emitting diode display panel 110 can be presented the effect of uniform brightness, and the display quality of the organic light emitting diode display panel 100 is enhanced. The following descriptions illustrate a method for driving the scanning signals of the organic light emitting diode display panel 110 under a three-dimensional display mode.

Figure 4A:
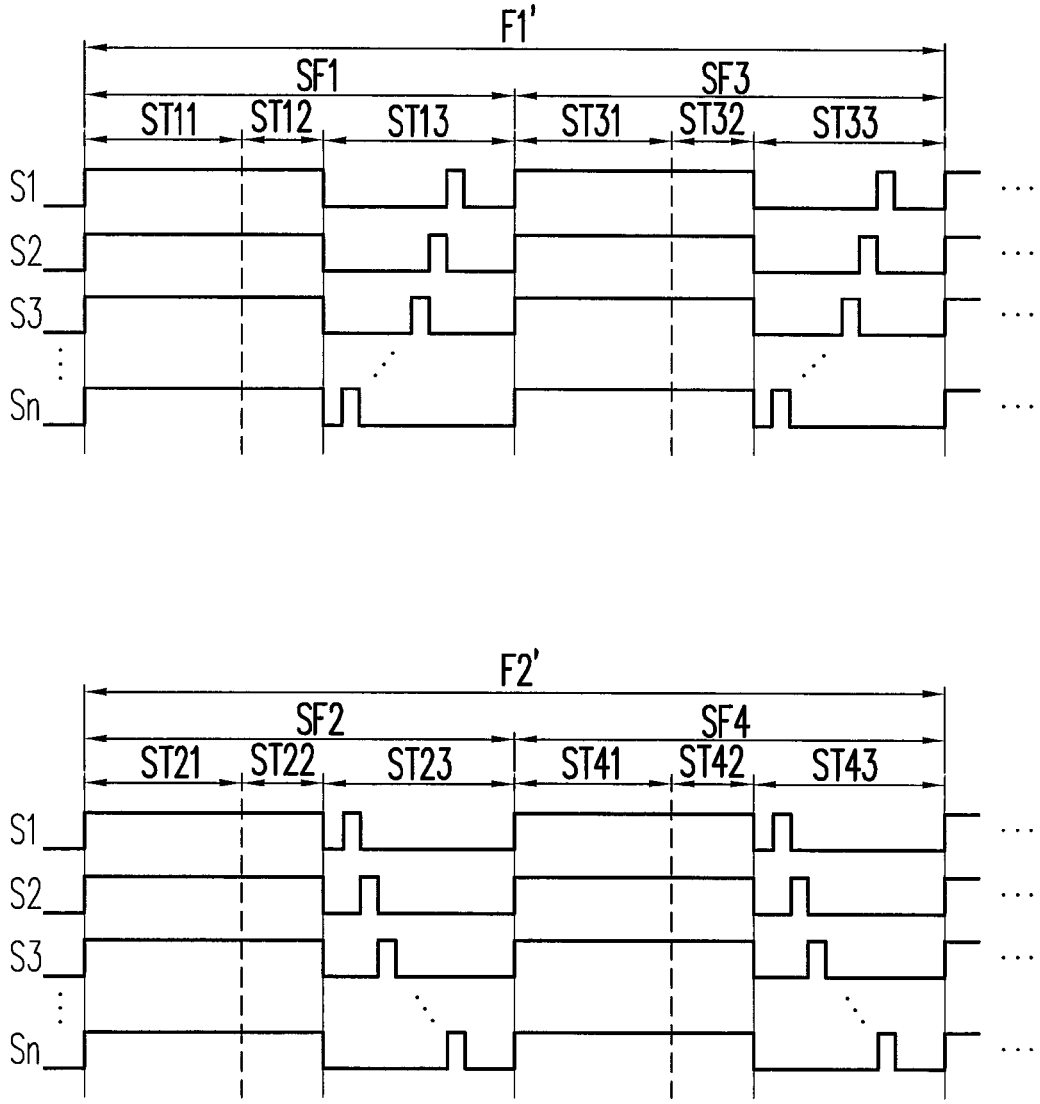
FIG. 4A and FIG. 4B are two schematic diagrams illustrating the driving timing of a plurality of scanning signals under a three-dimensional display mode in accordance with an embodiment.
Figure 4B:
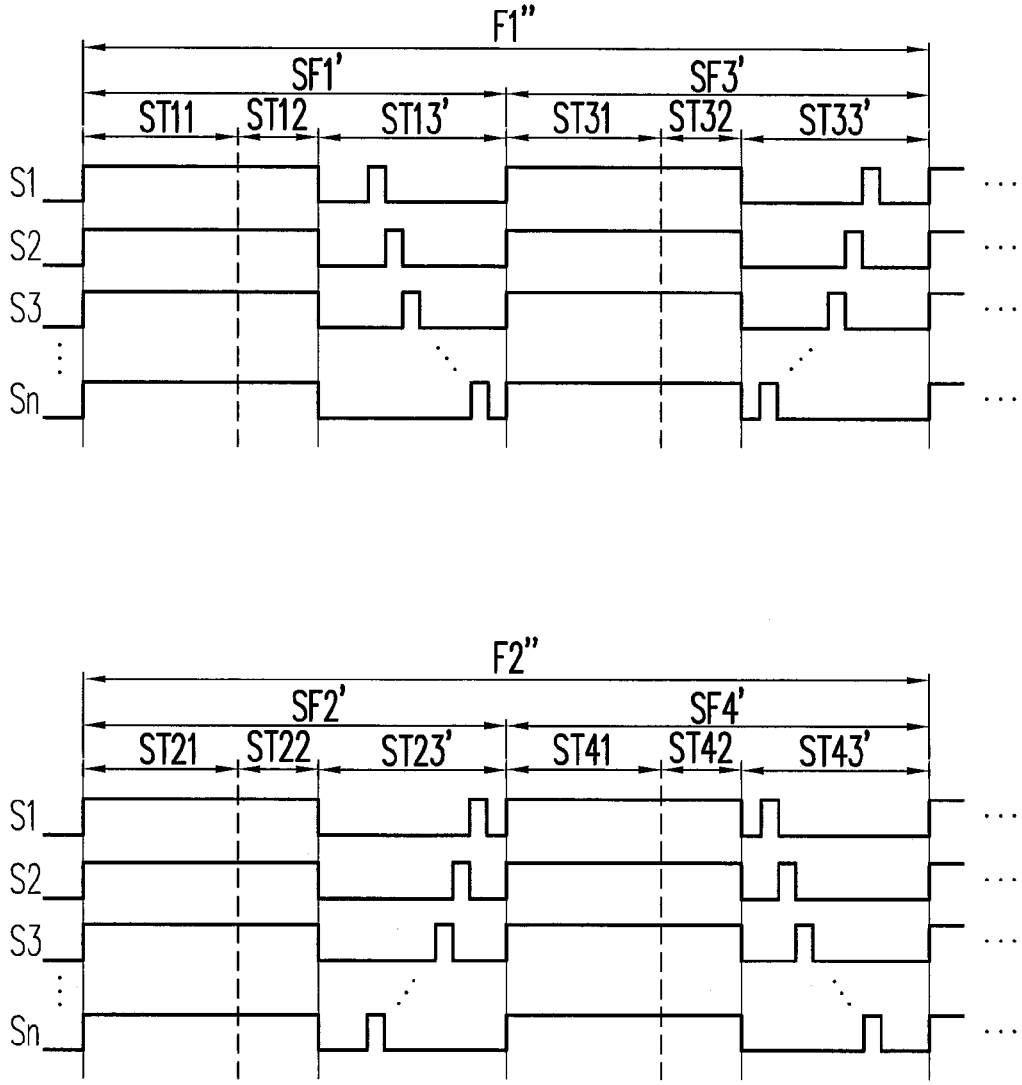

FIG. 4A and FIG. 4B are two schematic diagrams illustrating the driving timing of a plurality of scanning signals under a three-dimensional display mode in accordance with an embodiment. Referring to FIG. 3 and FIG. 4A, when the organic light emitting diode display panel 110 is in the three-dimensional display mode, namely, displaying a three-dimensional screen, the organic light emitting diode display panel 110 is scanned twice in a single frame period for respectively displaying the images corresponding to the left eye and the right eye. Since the scanning method for the organic light emitting diode display panel 110 is the same as the above-mentioned embodiment, the problem of uneven brightness still exists. According to the above, in order to balance the brightness distribution of the screen, the enabling sequences of the scanning signals S1~Sn of the scanning periods (e.g., ST13 and ST23) of the sub-frame periods corresponding to the same eye (e.g., a first sub-frame SF1 and a second sub-frame SF2) in two adjacent frame periods (e.g., a first frame F1' and a second frame F2') are opposite.

Furthermore, assuming the first frame period F1' has the first sub-frame SF1 and a third sub-frame SF3, and assuming the second frame period F2' has the second sub-frame SF2 and a fourth sub-frame SF4, wherein the organic light emitting diode display panel 110 displays a first eye image (e.g., left eye image) in the first sub-frame SF1 and the second sub-frame SF2, and the organic light emitting diode display panel 110 displays a second eye image (e.g., right eye image) in the third sub-frame SF3 and the fourth sub-frame SF4.

The first sub-frame SF1 has a reset period ST11, a threshold voltage cancelling period ST12 and a scanning period ST13. The second sub-frame SF2 has a reset period ST21, a threshold voltage cancelling period ST22 and a scanning period ST23. The third sub-frame SF3 has a reset period ST31, a threshold voltage cancelling period ST32 and a scanning period ST33. The fourth sub-frame SF4 has a reset period ST41, a threshold voltage cancelling period ST42 and a scanning period ST43. Wherein the actions of the organic light emitting diode display device 100 in the reset periods ST11, ST21, ST31, ST41, and the threshold voltage cancelling periods ST12, ST22, ST32, ST42 can be referred to the descriptions of the embodiment illustrated in FIG. 2, and thus are not repeated herein.

In the embodiment, the enabling sequence of the scanning signals S1~Sn in the scanning period ST13 of the first sub-frame period SF1 of the first frame period F1' is Sn~S1, the enabling sequence of the scanning signals S1~Sn in the scanning period ST23 of the second sub-frame period SF2 of the second frame period F2' is S1~Sn. Namely, the enabling sequence of the scanning signals S1~Sn in the scanning period ST13 is opposite to the enabling sequence of the scanning signals S1~Sn in the scanning period ST23. Therefore, brightness presented by the first eye image is uniform.

Moreover, the enabling sequence of the scanning signals S1~Sn in the scanning period T33 of the third sub-frame period SF3 of the first frame period F1' is Sn~S1, and the enabling sequence of the scanning signals S1~Sn in the scanning period T43 of the fourth sub-frame period SF4 of the second frame period F2' is S1~Sn. Namely, the enabling sequence of the scanning signals S1~Sn in the scanning period ST33 is opposite to the enabling sequence of the scanning signals S1~Sn in the scanning period ST43. Therefore, brightness presented by the second eye image is uniform.

In the embodiment, the enabling sequence of the scanning signals S1~Sn in the scanning period ST13 is the same as the enabling sequence of the scanning signals S1~Sn in the scanning period ST33, and the enabling sequence of the scanning signals S1~Sn in the scanning period ST23 is the same as the enabling sequence of the scanning signals S1~Sn in the scanning period ST43.

Referring to FIG. 4A and FIG. 4B, the embodiment of FIG. 4B is substantially the same as the embodiment of FIG. 4A, the difference is that the enabling sequence of the scanning signals S1~Sn in the scanning period ST13' of the first sub-frame period SF1' of the first frame period F1" is opposite to the enabling sequence of the scanning signals S1~Sn in the scanning period ST33' of the third sub-frame period SF3' of the first frame period F1", and the enabling sequence of the scanning signals S1~Sn in the scanning period ST23' of the second sub-frame period SF2' of the second frame period F2" is opposite to the enabling sequence of the scanning signals S1~Sn in the scanning period ST43' of the fourth sub-frame period SF4' of the second frame period F2".

Referring again to FIG. 1 and FIG. 2, according to FIG. 2, the scanning signals S1~Sn are sequentially enabled in the scanning period T3, and are simultaneously enabled in the reset period T1. The firstly enabled pixels PIX (such as the pixels PIX receiving the scanning signal S1) have more display time, so that the brightness displayed by the firstly enabled pixels PIX is brighter (in terms of the data voltages in correspondence with a same gray scale value), namely, much more current flows through the organic light emitting diode LED1 of the firstly enabled pixels PIX. In an embodiment, after received the displaying data DATA used for respectively transmitting a plurality of gray scale values, the timing controller 140 may adjust the voltage value corresponding to each of the gray scale values in accordance with the enabled timings of the scanning signals S1~Sn. Furthermore, the timing controller 140 may gradually raise the voltage value corresponding to each of the gray scale values in accordance with the enabled timings of the scanning signals S1~Sn. Namely, the voltage value corresponding to each of the gray scale values is gradually raised following the increasing of the enabled part of the scanning signals S1~Sn.

Taking the gray scale value 100 as an example, assuming that the data-voltages (e.g., D1~Dm) are originally corresponded to 1 volt (V), but following the increasing of the enabled part of the scanning signals S1~Sn, the voltage value corresponding to the gray scale values 100 is gradually raised (such as gradually raises according to 1.3V, 1.6V and 2.22V). Therefore, through the adjustment of the data-voltages (e.g., D1~Dm), the average brightness of each of the pixels PIX is the same when the each of the pixels PIX displays the same gray scale value, and thus the brightness uniformity of the organic light emitting diode display panel 100 is enhanced.

According to the above, the organic light emitting diode display device 100 can be disposed with a look-up table, and the timing controller 140 finds the corresponding voltage value of each of the gray scale values corresponding to each of the scanning signals S1~Sn by the look-up table. Or, the timing controller 140 may obtain the voltage value corresponding to each of the gray scale values through calculation, and the calculation thereof is accordingly designed by one of ordinary skill in the art, and thus the disclosure is not limited thereto.

Referring to FIG. 1, the electron/hole mobility of the driver transistor DT of each of the pixels PIX may be different due to the influence of the process, and thus the current flowing through the organic light emitting diode LED1 is influenced. Namely, under the same data-voltages (e.g., D1~Dm), the light emitting brightness of the organic light emitting diode LED1 of each of the pixels PIX may be different.

When the electron/hole mobility of the driver transistor DT is larger, the drain current of the driver transistor DT is larger, and thus the charging rate of the source electrode of the driver transistor DT is faster, namely, the raising speed of a voltage VS of the source electrode of the driver transistor DT is faster. When the raising speed of the voltage VS is faster, the shortening speed of the difference between the voltage VS and a voltage VG of the gate electrode of the driver transistor DT is faster, and thus the descending speed of the voltage VGS is faster, so that the conduction degree of the driver transistor DT is rapidly reduced. Therefore, the drain current of the driver transistor DT is rapidly limited so as to rapidly reduced.

When the electron/hole mobility of the driver transistor DT is smaller, the drain current of the driver transistor DT is smaller, and thus the charging rate of the source electrode of the driver transistor DT is slower, namely, the raising speed of the voltage VS of the source electrode of the driver transistor DT is slower. When the raising speed of the voltage VS is slower, the shortening speed of the difference between the voltage VS and the voltage VG of the gate electrode of the driver transistor DT is slower, and thus the descending speed of the voltage VGS is slower, so that the conduction degree of the driver transistor DT is slowly reduced. Therefore, the drain current of the driver transistor DT is not rapidly limited so as to slowly reduced.

According to the above, under the condition of the different electron/hole mobilities, the drain current of the driver transistors DT of the pixels PIX is automatically balanced during a transient state of the circuit operation thereof. Under the condition of the drain current of the driver transistor DT is larger, the influence caused by the electron/hole mobility of the driver transistor DT is more obvious, the embodiment may be setting the time length of the enabling period of the scanning signals S1~Sn corresponded to the period of larger drain current of the driver transistor DT, so as to compensate the electron/hole mobility of the driver transistor DT.

Figure 5:
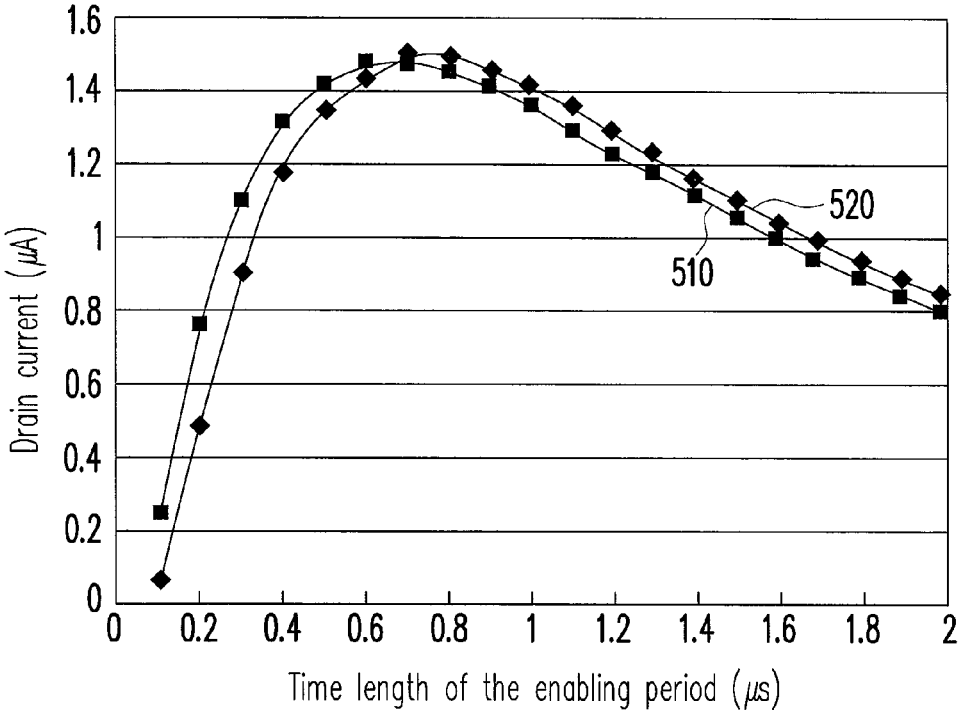
FIG. 5 is a curve diagram illustrating the drain current of the driver transistor relative to the time length of the enabling periods of the scanning signals in accordance with an embodiment.

FIG. 5 is a curve diagram illustrating the drain current of the driver transistor relative to the time length of the enabling periods of the scanning signals in accordance with an embodiment. Referring to FIG. 1 and FIG. 5, the X axis is the time length of the enabling period of the scanning signals S1~Sn, and the Y axis is the drain current of the driver transistor DT. Wherein, a curve 510 is corresponding to a central region of the organic light emitting diode display panel 100, a curve 520 is corresponding to a peripheral region of the organic light emitting diode display panel 100, and the curve 510 is substantially the same as the curve 520, but may be different due to the loading effects of resistor and capacitor. As shown in FIG. 5, When the time length of the enabling period of the scanning signals is set between 0.5~2 μs, the drain current of the driver transistor DT is greater than 0.8 μA, so that the time length of the enabling period of the scanning signals may be set between 0.5~2 μs. Furthermore, the peaks of the curves 510 and 520 approximately correspond to the time length ranging from 0.6 μs to 0.8 μs of the enabling period of the scanning signals. Therefore, the time length of the enabling period of the scanning signals may be set between 0.6~0.8 μs, but the embodiment is not limited thereto.

Figure 6:
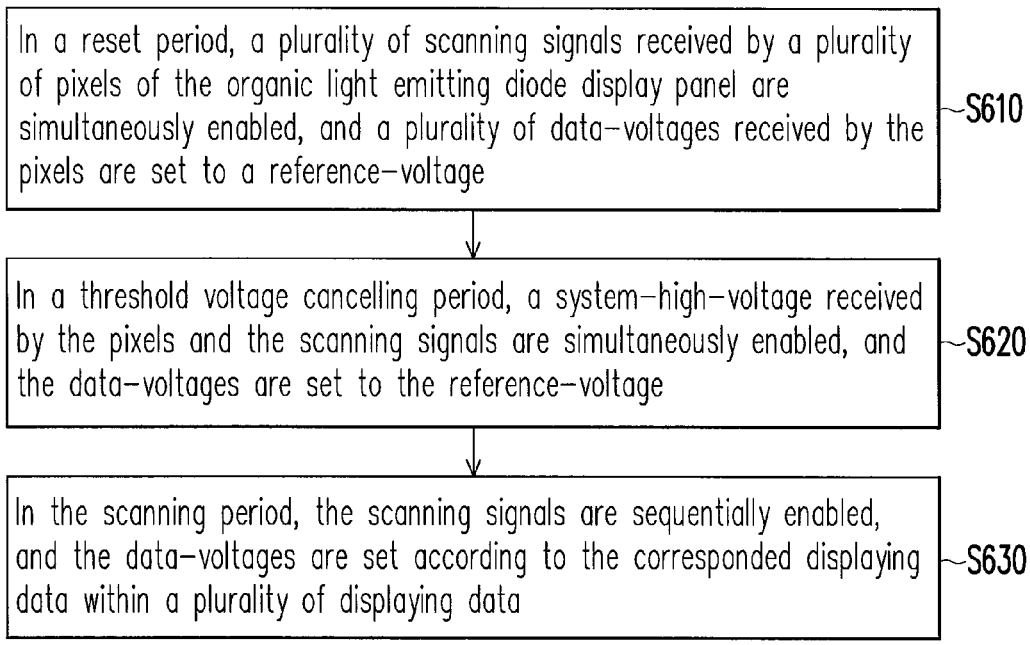
FIG. 6 is a flow chart illustrating a method for driving an organic light emitting diode display panel in accordance with an embodiment.

According to each of the embodiments of the organic light emitting diode display device, a method for driving an organic light emitting diode display panel may be compiled. FIG. 6 is a flow chart illustrating a method for driving an organic light emitting diode display panel in accordance with an embodiment. Referring to FIG. 6, in the embodiment, the method for driving the organic light emitting diode display panel comprises the following steps. Firstly, in a reset period, a plurality of scanning signals received by a plurality of pixels of the organic light emitting diode display panel are simultaneously enabled, and a plurality of data-voltages received by the pixels are set to a reference-voltage (step S610). Next, in a threshold voltage cancelling period, a system-high-voltage received by the pixels and the scanning signals are simultaneously enabled, and the data-voltages are set to the reference-voltage (step S620). Lastly, in the scanning period, the scanning signals are sequentially enabled, and the data-voltages are set according to the corresponded displaying data within a plurality of displaying data, wherein the enabling periods of the scanning signals do not overlap with each other (step S630). Wherein, the details of the aforesaid steps may be referred to the descriptions of the embodiments illustrated in FIG. 1 to FIG. 6, and thus are not repeated herein.

In summary, in the organic light emitting diode display device and the method for driving an organic light emitting diode display panel of the embodiments of the disclosure, in the threshold voltage cancelling period, the scanning signals and the system-high-voltage received by the pixels are simultaneously enabled, and the data-voltages are set to the reference-voltage, so that the storage capacitor of each of the pixels is able to store the threshold voltage of the driver transistor to compensate the threshold voltage of the driver transistor. Moreover, in the reset period, the system-high-voltage received by the pixels may be disabled, so as to speed up the discharging rate of the pixels. In addition, the time length of the enabling period of the scanning signals may be set targeting the larger part of the drain current of the driver transistor, so as to automatically compensate the electron/hole mobility through the transient state of the circuit operation of the pixel circuit.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A method for driving an organic light emitting diode display panel comprising:

in a reset period, simultaneously enabling a plurality of scanning signals received by a plurality of pixels of the organic light emitting diode display panel, and setting a plurality of data-voltages received by the pixels to a reference-voltage;

in a threshold voltage cancelling period, simultaneously enabling a system-high-voltage received by the pixels and the scanning signal, and setting the data-voltages to the reference-voltage; and in a scanning period, sequentially enabling the scanning signals, and setting the data-voltages according to the corresponded displaying data within a plurality of displaying data, wherein the organic light emitting diode display panel displays a three-dimensional screen constituted by a first eye image and a second eye image, the enabling sequence of the scanning signals in the scanning period of a first sub-frame period of a first frame period is opposite to the enabling sequence of the scanning signals in scanning period of a second sub-frame period of a second frame period, the enabling sequence of the scanning signals in the scanning period of a third sub-frame period of the first frame period is opposite to the enabling sequence of the scanning signals in the scanning period of a fourth sub-frame period of the second frame period, the first sub-frame period and the second sub-frame period are corresponded to the first eye image, and the third sub-frame period and the fourth sub-frame period are corresponded to the second eye image.

2. The method for driving the organic light emitting diode display panel as recited in claim 1, wherein the enabling sequence of the scanning signals in the scanning period of the first sub-frame period is the same as the enabling sequence of the scanning signals in the scanning period of the third sub-frame period.

3. The method for driving the organic light emitting diode display panel as recited in claim 1, wherein the enabling sequence of the scanning signals in the scanning period of the first sub-frame period is opposite to the enabling sequence of the scanning signals in the scanning period of the third sub-frame period.

4. The method for driving the organic light emitting diode display panel as recited in claim 1, wherein the first frame period is adjacent to the second frame period.

5. The method for driving the organic light emitting diode display panel as recited in claim 1, wherein the displaying data respectively transmits a plurality of gray scale values, and a plurality of voltage values corresponding to the gray scale values are adjusted in accordance with the enabled timings of the scanning signals.

6. The method for driving the organic light emitting diode display panel as recited in claim 5, wherein the steps of the voltage values corresponding to the gray scale values are adjusted in accordance with the enabled timings of the scanning signals comprise:

gradually increasing the voltage values corresponding to the gray scale values in accordance with the enabled timings of the scanning signals.

7. The method for driving the organic light emitting diode display panel as recited in claim 1, wherein the time lengths of the enabling periods of the scanning signals are between 0.5~2 μs in the scanning period.

8. The method for driving the organic light emitting diode display panel as recited in claim 7, wherein the time lengths of the enabling periods of the scanning signals can be between 0.6~0.8 μs.

9. The method for driving the organic light emitting diode display panel as recited in claim 1, wherein the system-high-voltage is disabled in the reset period.

10. The method for driving the organic light emitting diode display panel as recited in claim 1, wherein in the scanning period, the enabling periods of the scanning signals do not overlap with each other.

11. An organic light emitting diode display device comprising:

an organic light emitting diode display panel, having a plurality of pixels;

a power supply unit, coupling to the organic light emitting diode display panel to provide a system-high-voltage and a system-low-voltage to the pixels;

a data driver, coupling to organic light emitting diode display panel to provide a plurality of data-voltages to the pixels;

a scan driver, coupling the organic light emitting diode display panel to provide a plurality of scanning signals to the pixels; and a timing controller, coupling to the data driver and the scan driver; in a reset period, the timing controller controls the scan driver to simultaneously enable the scanning signals, and controls the data driver to set the data-voltages to a reference-voltage; in a threshold voltage cancelling period, the timing controller controls the scan driver to simultaneously enable the scanning signals, controls the power supply unit to enable the system-high-voltage, and controls the data driver to set the data-voltages to the reference-voltage; in a scanning period, the timing controller controls the scan driver to sequentially enable the scanning signals, and controls the data driver to set the data-voltages according to a plurality of displaying data, wherein the enabling sequence of the scanning signals in the scanning period of a first sub-frame period of a first frame period is opposite to the enabling sequence of the scanning signals in scanning period of a second sub-frame period of a second frame period, the enabling sequence of the scanning signals in the scanning period of a third sub-frame period of the first frame period is opposite to the enabling sequence of the scanning signals in the scanning period of a fourth sub-frame period of the second frame period, the first sub-frame period and the second sub-frame period are corresponded to a first eye image, the third sub-frame period and the fourth sub-frame period are corresponded to a second eye image and the first eye image and the second eye image are used to constitute a three-dimensional screen.

12. The organic light emitting diode display device as recited in claim 11, wherein the enabling sequence of the scanning signals in the scanning period of the first sub-frame period is the same as the enabling sequence of the scanning signals in the scanning period of the third sub-frame period.

13. The organic light emitting diode display device as recited in claim 11, wherein the enabling sequence of the scanning signals in the scanning period of the first sub-frame period is opposite to the enabling sequence of the scanning signals in the scanning period of the third sub-frame period.

14. The organic light emitting diode display device as recited in claim 11, the first frame period is adjacent to the second frame period.

15. The organic light emitting diode display device as recited in claim 11 further comprising a look-up table, and the displaying data respectively transmits a plurality of gray scale values, wherein the timing controller adjusts a plurality of voltage values corresponding to the gray scale values in accordance with the look-up table and the enabled timings of the scanning signals.

16. The organic light emitting diode display device as recited in claim 15, wherein the timing controller gradually raises the voltage values corresponding to the gray scale values in accordance with the look-up table and the enabled timings of the scanning signals.

17. The organic light emitting diode display device as recited in claim 11, wherein the time lengths of the enabling periods of the scanning signals are between 0.5~2 μs in the scanning period.

18. The organic light emitting diode display device as recited in claim 17, wherein the time lengths of the enabling periods of the scanning signals can be between 0.6~0.8 μs.

19. The organic light emitting diode display device as recited in claim 11, wherein the timing controller controls the power supply unit to disable the system-high-voltage in the reset period.

20. The organic light emitting diode display device as recited in claim 11, wherein in the scanning period, the enabling periods of the scanning signals do not overlap with each other.

* * * * *